US006180310B1

(12) United States Patent
Pinsly

(10) Patent No.: US 6,180,310 B1
(45) Date of Patent: Jan. 30, 2001

(54) DIP COATING PROCESS

(75) Inventor: Jeremy B. Pinsly, Rochester, NY (US)

(73) Assignee: Xerox Corporation, Stamford, CT (US)

( * ) Notice: Under 35 U.S.C. 154(b), the term of this patent shall be extended for 0 days.

(21) Appl. No.: 09/637,163

(22) Filed: Aug. 14, 2000

(51) Int. Cl.[7] ..... G03G 5/047
(52) U.S. Cl. ..... 430/131; 430/132; 427/430.1
(58) Field of Search ..... 430/131, 132; 427/430.1

(56) References Cited

U.S. PATENT DOCUMENTS

| | | | | |
|---|---|---|---|---|
| 5,120,627 | * | 6/1992 | Nozomi et al. | 430/132 |
| 5,149,612 | | 9/1992 | Langlois et al. | 430/132 |
| 5,578,410 | * | 11/1996 | Petropoulos et al. | 427/430.1 |
| 5,599,646 | * | 2/1997 | Foley et al. | 430/132 |
| 5,633,046 | * | 5/1997 | Petropoulos et al. | 427/430.1 |
| 5,693,372 | | 12/1997 | Mistrater et al. | 427/430.1 |

* cited by examiner

*Primary Examiner*—Roland Martin
(74) *Attorney, Agent, or Firm*—John L. Haack; Peter Kondo

(57) ABSTRACT

A process for fabricating an electrophotographic imaging member including providing a cylindrical member, depositing on the cylindrical member a coating of a first charge transport layer coating solution by dip coating the cylindrical member in a bath of the first charge transport layer coating solution in a dip coating vessel, the first charge transport layer coating solution including a film forming polymer, a charge transport material, and at least one volatile solvent, the first charge transport layer coating solution having a first predetermined viscosity and the solvent having a viscosity less than the first predetermined viscosity, recirculating undeposited first charge transport layer coating solution from the dip coating vessel to a charge transport layer coating solution vessel and back to the dip coating vessel, repeatedly and sequentially depositing on fresh cylindrical members a coating of the recirculating undeposited first charge transport layer coating solution by dip coating the fresh cylindrical members in a bath of the recirculating undeposited first charge transport layer coating solution in the dip coating vessel, recirculating undeposited first charge transport layer coating solution from the dip coating vessel to the charge transport layer coating solution vessel until the first charge transport layer coating solution reaches a second predetermined viscosity that is greater than the first predetermined viscosity, adding a replenishment solvent from a solvent vessel to the recirculating undeposited first charge transport layer coating solution with continuous mixing to form a second charge transport layer coating solution having a viscosity less than the second predetermined viscosity and substantially equal to or greater than the first predetermined viscosity, flowing the second charge transport layer coating solution along a tortuous path in a static mixer to form a homogeneous second charge transport layer coating solution, flowing the homogeneous second charge transport layer coating solution from the static mixer into the dip coating vessel while maintaining laminar flow in the homogeneous second charge transport layer coating solution flowing into the dip coating vessel, and repeatedly and sequentially depositing the stirred second charge transport layer coating solution on additional fresh cylindrical members in the dip coating vessel.

22 Claims, 1 Drawing Sheet

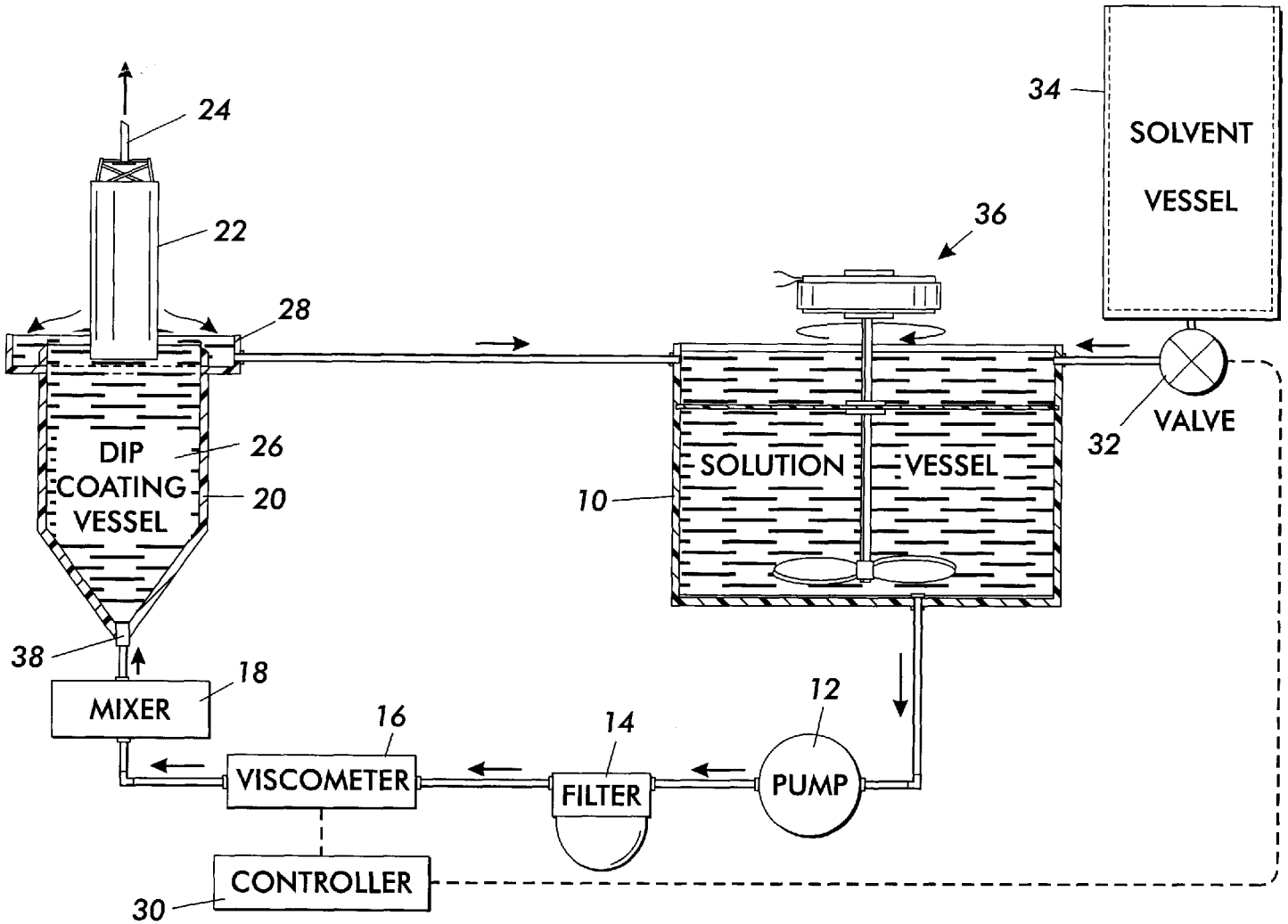
SOLVENT
VESSEL
34
VALVE
32
36
VESSEL
SOLUTION
10
PUMP
12
FILTER
14
VISCOMETER
16
CONTROLLER
30
MIXER
18
38
DIP
COATING
VESSEL
20
26
28
22
24

DIP COATING PROCESS

BACKGROUND OF THE INVENTION

This invention relates in general to dip coating and, more specifically, to a process for dip coating drums with a charge transport layer coating composition.

In the art of xerography, a xerographic plate containing a photoconductive insulating layer is imaged by first uniformly electrostatically charging its surface. The plate is then exposed to a pattern of activating electromagnetic radiation such as light, which selectively dissipates the charge in the illuminated areas of the photoconductive insulator while leaving behind an electrostatic latent image in the non-illuminated areas. This electrostatic latent image may then be developed to form a visible image by depositing finely divided electroscopic marking particles on the surface of the photoconductive insulating layer.

A photoconductive layer for use in xerography may be a homogeneous layer of a single material such as vitreous selenium or it may be a composite layer containing a photoconductor and another material. One type of composite photoconductive layer used in xerography is illustrated in U.S. Pat. No. 4,265,990 in which a photosensitive member having at least two electrically operative layers is described. One layer comprises a photoconductive layer which is capable of photogenerating holes and injecting the photogenerated holes into a contiguous charge transport layer.

Various combinations of materials for charge generating layers and charge transport layers have been investigated. For example, the photosensitive member described in U.S. Pat. No. 4,265,990 utilizes a charge generating layer in contiguous contact with a charge transport layer comprising a polycarbonate resin and one or more of certain aromatic amine compound. Various generating layers comprising photoconductive layers exhibiting the capability of photogeneration of holes and injection of the holes into a charge transport layer have also been investigated. Typical photoconductive materials utilized in the generating layer include amorphous selenium, trigonal selenium, and selenium alloys such as selenium-tellurium, selenium-tellurium-arsenic, selenium-arsenic, and mixtures thereof. The charge generation layer may comprise a homogeneous photoconductive material or particulate photoconductive material dispersed in a binder. Other examples of homogeneous and binder charge generation layer are disclosed in U.S. Pat. No. 4,265,990. Additional examples of binder materials such as poly(hydroxyether) resins are taught in U.S. Pat. No. 4,439,507. The disclosures of the aforesaid U.S. Pat. No. 4,265,990 and U.S. Pat. No. 4,439,507 are incorporated herein in their entirety. Photosensitive members having at least two electrically operative layers as disclosed above in, for example, U.S. Pat. No. 4,265,990 provide excellent images when charged with a uniform negative electrostatic charge, exposed to a light image and thereafter developed with finely developed electroscopic marking particles. However, when the charge transport layer is applied by dip coating in extensively recirculated charge transport layer coating compositions, difficulties have been encountered due to the formation of coating non-uniformities such as axial or circumferential streaks appearing in the final charge transport layer. These streaks are undesirable because they may cause variations in the surface energy potential when an electrical charge is applied to the surface of the final charge transport layer which may cause printing defects in the final image, such as variations in light and dark final image print density. Also, stratification or segregation has been observed in the recirculated charge transport layer coating compositions which are believed to cause variations in viscosity control, coating thickness and electrical properties of the charge transport layer.

Variations in charge transport layer coating solution viscosity while coating, sudden and small charge transport layer coating solution flow rate changes, among other mechanisms, cause variations in coating material thickness. This thickness variation can be on any given drum or on different drums (batch-to-batch variations).

Thus, the characteristics of dip coating systems for forming a dip coated charge transport layer exhibit deficiencies which are undesirable for producing photoreceptors for high quality copiers, duplicators, printers, fax machines, multifunctional devices and the like.

INFORMATION DISCLOSURE STATEMENT

U.S. Pat. No. 5,149,612 issued to Langlois et al., on Sep. 22, 1992—Processes and apparatus for fabricating an electrophotographic imaging member in which a web coated with a charge generation layer is coated with a charge transport layer comprising a dopant, the improvement comprising detecting the change in dopant concentration required, determining the amount of highly doped charge transport composition and amount of undoped or lowly doped charge transport composition required to achieve the change in dopant concentration, feeding the determined amounts of highly doped charge transport composition and undoped or lowly doped charge transport composition into a mixing zone, rapidly mixing the amounts of highly doped charge transport composition and undoped or lowly doped charge transport composition to form a uniformly doped charge transport composition, and applying the uniformly doped charge transport composition to the charge generation layer.

U.S. Pat. No. 5,693,372 to Mistrater et al, issued Dec. 2, 1997—A process is disclosed for dip coating drums comprising providing a drum having an outer surface to be coated, an upper end and a lower end, providing at least one coating vessel having a bottom, an open top and a cylindrically shaped vertical interior wall having a diameter greater than the diameter of the drum, flowing liquid coating material from the bottom of the vessel to the top of the vessel, immersing the drum in the flowing liquid coating material while maintaining the axis of the drum in a vertical orientation, maintaining the outer surface of the drum in a concentric relationship with the vertical interior wall of the cylindrical coating vessel while the drum is immersed in the coating material, the outer surface of the drum being radially spaced from the vertical interior wall of the cylindrical coating vessel, maintaining laminar flow motion of the coating material as it passes between the outer surface of the drum and the vertical interior wall of the vessel, maintaining the radial spacing between the outer surface of the drum and the inner surface of the vessel between about 2 millimeters and about 9 millimeters, and withdrawing the drum from the coating vessel.

BRIEF SUMMARY OF THE INVENTION

It is, therefore, an object of the present invention to provide an improved coating process which overcomes the above-noted disadvantages.

It is another object of the present invention to provide an improved coating process which rapidly adjusts viscosity properties of a layer dip coating composition to more consistently achieve photoreceptors having high quality layers.

It is still another object of the present invention to provide an improved coating process which permits rapid viscosity adjustments to the charge transport coating composition while the photoreceptor fabrication process is in progress.

It is yet another object of the present invention to provide an improved coating process which prevents the formation of streaks during formation of charge transport layers during dip coating.

It is another object of the present invention to provide an improved coating process which reduces the number of unacceptable dip coated photoreceptor drums having streaked charge transport layers.

It is still another object of the present invention to provide an improved coating process which provides improved charge transfer layer coating thickness uniformity; provides improved coating solution homogeneity, and applied surface charge uniformity.

The foregoing objects and others are accomplished in accordance with this invention by providing a member comprising a process for fabricating an electrophotographic imaging member comprising providing a cylindrical member, depositing on the cylindrical member a coating of a first charge transport layer coating solution by dip coating the cylindrical member in a bath of the first charge transport layer coating solution in a dip coating vessel, the first charge transport layer coating solution comprising a film forming polymer, a charge transport material, and at least one volatile solvent, the first charge transport layer coating solution having a first predetermined viscosity and the solvent having a viscosity less than the first predetermined viscosity, recirculating undeposited first charge transport layer coating solution from the dip coating vessel to a charge transport layer coating solution vessel and back to the dip coating vessel, repeatedly and sequentially depositing on fresh cylindrical members a coating of the recirculating undeposited first charge transport layer coating solution by dip coating the fresh cylindrical members in a bath of the recirculating undeposited first charge transport layer coating solution in the dip coating vessel, recirculating undeposited first charge transport layer coating solution from the dip coating vessel to the charge transport layer coating solution vessel until the first charge transport layer coating solution reaches a second predetermined viscosity that is greater than the first predetermined viscosity, adding a replenishment solvent from a solvent vessel to the recirculating undeposited first charge transport layer coating solution with continuous mixing to form a second charge transport layer coating solution having a viscosity less than the second predetermined viscosity and substantially equal to the first predetermined viscosity, flowing the second charge transport layer coating solution along a tortuous path in a static mixer to form a homogeneous second charge transport layer coating solution, flowing the homogeneous second charge transport layer coating solution from the static mixer into the dip coating vessel while maintaining laminar flow in the homogeneous second charge transport layer coating solution flowing into the dip coating vessel, and repeatedly and sequentially depositing the stirred second charge transport layer coating solution on additional fresh cylindrical members in the dip coating vessel.

DESCRIPTION OF THE DRAWINGS

A more complete understanding of the present invention can be obtained by reference to the accompanying drawings wherein:

FIG. 1 is a schematic representation of apparatus for carrying out the process in accordance with the invention.

This figure merely schematically illustrates the invention and is not intended to indicate relative size and dimensions of the apparatus or components thereof. Most of the dimensions are exaggerated to more clearly illustrate the invention.

DETAILED DESCRIPTION OF THE DRAWING

Referring to FIG. 1, a solution vessel 10 is employed to contain a first charge transport layer coating solution having a first predetermined viscosity. The first charge transport layer coating solution is pumped by a pump 12 through an optional filter 14, viscometer 16 and static mixer 18 into dip coating vessel 20.

Any suitable pump 12 may be employed. Typical pumps include, for example, gear pumps, diaphragm pumps, piston pumps, peristaltic pumps, centrifugal pumps, lobe pumps, and the like. The size of the pump utilized depends upon the volume rate desired. Volume rate depends upon dip coating material consumption, coating thickness and other predetermined factors.

Any suitable filter 14 may be used. Typical filters include those fabricated from sintered metal, crimped metal, sintered ceramics, polypropylene, and the like. If desired, one or more filters may be utilized elsewhere in the system to filter the coating solutions and/or solvents.

Any suitable viscometer 16 may be employed. Typical viscometers include, for example, Cambridge, Sofraser, and the like. A preferred known viscometer is a Cambridge viscometer, Model SPC-311 with Model BMC-113 electronics.

Any suitable static mixer 18 may be used. Typical static mixers include, for example, Chemineer, Koch, and the like. Static mixer 18 is a non-moving in-line mixing device which rapidly and thoroughly mixes the recirculating solution and fresh solvent in the shortest possible time and in the shortest possible distance. This static mixer also enhances thermal homogeneity of the coating solution. Thus, such mixing is preferably accomplished at ambient room temperature. The static mixer does not incur large pressure drops and can be cleaned in place. Mixer 18 is preferably a short static mixer comprising a straight tube containing baffles such as a spiral baffle along its short length. Preferably, the static mixer is less than about 20 inches (51 centimeters) long. Generally, the static mixer length is determined by the diameter of the piping in which the static mixer is to be installed. Thus, in a typical example, where the inside diameter of connecting piping is about 1 inch (2.5 centimeters) a static mixer (e.g., Model #1 KMR SAN-12 mixer, available from Koch-Glitsch) made up of elements 1.5 inches (3.8 centimeters) long, the minimum number of elements required is 6 for achieving homogeneity of the transport layer coating composition. Thus, the length of the resulting static mixer is 9 inches (22.9 centimeters). This basic static mixer comprised of a 6 element segment can be stacked together, e.g., 2 segments in series to provides a 12 element static mixer having a length of 18 inches (45.7 centimeters). Optimum results may be achieved with a length of less than about 45.7 centimeters. Generally, the shortest length for a static mixer also depends upon the diameter of the piping in which the mixer will be installed. Where the inside diameter of connecting piping is about 1 inch (2.5 centimeters), a typical minimum length is about 9 inches (22.8 centimeters). However, as stated above, the ultimately selected length to achieve homogeneity of the transport layer coating composition will depend on the diameter of the piping in which the mixer will be installed. A typical tubular static mixer having a length of about 18 inches (45.7 centimeters) and containing internal baffles such as a spiral elements (not shown) comprising 12 mixing element spirals can achieve complete physical mixing of the recirculating solution and fresh replenishment solvent to form a homogeneous solution. Static mixing pipes are preferred because the devices are easily degasified, mix materials in a very short distance, do not introduce bubbles into the coating mixture, and are easy to clean. Generally, mixing devices that introduce bubbles are to be avoided because the entrained bubbles will cause defects in the final dried coating. Another reason for preferring static mixing pipes is the relatively small volume material present in the device which reduces loss when the device is cleaned. Also, purging may be readily accomplished merely by inclining the mixing pipe. Further, mixing is effected at an extremely rapid rate so that mixing can be accomplished without shutting down the entire coating apparatus. Thus, mixing is accomplished on-line and the mixed material is utilized immediately after mixing. More specifically, with static mixing pipes, only small volumes of material are mixed at any given moment in time, mixing is accomplished extremely rapidly and only a small amount of material is lost during cleaning. A preferred static mixer 18 is short, e.g. 9 inches (22.9 centimeters) long, and comprises a curved or flat baffle element (not shown), e.g. a baffle with 12 spirals which ensures complete mixing of the two coating solutions. Static mixers are well known and are commercially available, e.g. Model 1.5-30-431-8, available from Chemineer and the like. An especially preferred mixer is a Model #1 KMR SAN-12 static mixer, available from Koch-Glitsch. The static mixers may be made of any suitable material. Typical materials include, for example, stainless steel, titanium, and the like. Preferably, mixing should be complete by the time the coating solution exits the static mixer 18. It is desirable that the coating solution be homogeneous immediately prior to entering the dip coating vessel. Because of their compact size, small static mixers can be located very close to the inlet of a dip coating vessel to prevent separation of coating components and ensure solution homogeneity prior to entering the dip coating vessel. Coating solution homogeneity at the time the solution is coated on the substrate is important to prevent variations over the length of the substrate while it is being coated. Thus, if the coating solution is homogeneous immediately prior to entering the dip coating vessel, the solution tends to remain homogeneous inside the dip coating vessel and also when the solution is deposited as a coating. Since the flow of the coating solution inside the dip coating vessel is laminar, mixing essentially does not take place inside the dip coating vessel. Thus, the static mixer 18 should be positioned as close as possible to the inlet 38 of the dip coating vessel 20 and preferably immediately prior to the inlet 38 of a dip coating vessel 20 or the inlet to a manifold leading to one or more dip coating vessels (not shown). Preferably, the distance between the outlet of the static mixer 18 and the inlet 38 of the dip coating vessel 20 is less than about 0.9 meter (3 feet). Long runs between the static mixer 18 and the inlet 38 of the coating vessel 20 can defeat the effectiveness of the mixer because the coating solutions may become non-homogeneous prior to entering the inlet 38 of the dip coating vessel 20. Although the replenishment solvents are miscible with the recirculating charge transport layer coating composition, the replenishment solvents are of a markedly different viscosity than the recirculating charge transport layer coating composition (e.g., between about 0.5 centipoise and about 3 centipoise for replenishment solvents vs. between about 250 centipoise and about 500 centipoise for charge transport layer coating solutions) and tend to stratify rather than form a homogeneous solution or remain a homogeneous solution unless the replenishment solvents are properly and efficiently mixed with the coating solution to form a homogeneous solution. Manifolds (not shown) are usually employed to feed a solution to multiple dip coating tanks. Where a plurality of coating vessels receive coating composition from a common manifold, it is preferred that a single static mixer be employed at the inlet to each manifold. Alternatively, a static mixer may be positioned at the inlet of each tank instead of or in addition to one being positioned at the inlet of the manifold. Dip coating vessels connected to manifolds are well known and described, for example, in U.S. Pat. No. 5,693,372, the entire disclosure thereof being incorporated herein by reference. Generally, turbulent flow of the coating composition in the piping at the inlet of the dip coating vessel is undesirable because the turbulence may lead to non-uniform coating thicknesses on the drum. It is desirable that laminar flow is achieved in the piping before entering the static mixer 18 and after leaving the static mixer 18 to ensure laminar flow inside the static mixer 18.

The first charge transport layer coating solution is applied as a coating to cylindrical member 22 by conventional techniques such as using a vertically reciprocatable mandrel 24 which immerses most of cylindrical member 22 into a bath 26 of the first charge transport layer coating solution. Generally, a narrow band or strip around the top of cylindrical member 22 remains uncoated (not shown) to facilitate operation during use in subsequent imaging processes. Undeposited first charge transport layer coating solution overflows the open upper end of dip coating vessel 20 into a trough 28. This undeposited first charge transport layer coating solution is recirculated from the dip coating vessel 20 to the charge transport layer coating solution vessel 10 and back to the dip coating vessel 20. When initially used, the first charge transport layer coating solution has a first predetermined viscosity which does not cause streaks to form during dip coating. During repeated use, the recirculating first charge transport layer coating solution gradually loses solvent due to evaporation and begins to exhibit an increase in viscosity. The viscosity eventually increases to a threshold level where streaks begin to form in the charge transport layer formed on the cylindrical member 22 by the dip coating process. A target maximum viscosity value can be determined experimentally, the target maximum viscosity value being greater than the initial viscosity value but below the viscosity value at which streaks begin to form. This target maximum viscosity value is referred to herein as the second predetermined viscosity and can be programmed into the controller as a trigger point for introduction of fresh replenishment solvent to reduce coating solution viscosity. The viscosity of the recirculating charge transport layer coating solution is monitored by viscometer 16 which preferably continuously or intermittently transmits the viscosity data to controller 30. When the viscosity of the recirculating charge transport layer coating solution reaches the second predetermined viscosity (which is always greater than the first predetermined viscosity), the controller 30 transmits a signal to control valve 32. Preferably, valve 32 is an air-actuated ball valve. Ball valves essentially have 2 positions: open or closed (on or off), and are typically actuated by a digital output from a device such as a PLC. The solvent contained in solvent vessel 34 is under pressure, so when the valve 32 is opened, flow is enabled from the solvent vessel 34 into the solution vessel 10 because the solution vessel is not pressurized. The volume flow rate of solvent from the solvent vessel 34 will depend on the diameter of the piping and associated fittings connecting solvent vessel 34 to solution vessel 10 and the head pressure in solvent vessel 34. Any suitable device may be utilized to start and stop the supply of solvent from solvent vessel 34. Typical devices for starting and stopping the supply of solvent from solvent vessel 34 include, for example, a gear pump or other suitable metering device. Although less desirable because of added complexity, another pump can be employed to transfer solvent into the solution vessel 10. Thus, for example, a metering pump, or a pump and a mass totalizing flow meter, or a load cell (scale) to measure the amount of solvent added into the solution vessel may be utilized to continuously or intermittently introduce fresh replenishment solvent from solvent vessel 34 into solution vessel 10. Preferably, the controller controls a valve that employs about a variable opening cycle. This opening cycle can be repeated until the first predetermined viscosity is attained in the recirculating charge transport layer coating composition. The replenishment solvent added to the recirculating charge transport layer coating solution has a much lower viscosity than the recirculating charge transport layer coating solution itself. For example, a conventional replenishment solvent can have a viscosity of about 1 centipoise whereas the recirculating charge transport layer coating solution can have a viscosity of about 300 centipoise. Generally, when relatively large quantities of replenishment solvent are periodically added to the recirculating charge transport layer coating composition to return the coating composition back to an optimum predetermined viscosity, the thickness of the deposited dip coating varies with the variations in viscosity so that a chart (thickness in micrometers vs. time of the coating thickness of dip coated drums from one batch to the next batch may resemble a sine wave. With the process of this invention, small and equal quantities of replenishment solvent from the solvent vessel 34 can be incrementally added to the solution vessel 10 over evenly spaced intervals of time so that large and rapid changes in the coating solution viscosity are not introduced into the system. The total coating amount recirculating charge transport layer coating solution being recirculated does not appear critical, however the process of this invention enables a predetermined specific range of quantities of solvent to be added to the solution vessel in order to reduce the viscosity from the second predetermined viscosity to about the first predetermined viscosity. This addition of replenishment solvent to the recirculating charge transport layer coating composition minimizes large fluctuations in viscosity and the variation of thickness of the deposited coating resembles a substantially straight horizontal line when thickness (vertical axis) is plotted against time (horizontal axis). Thus, large changes in the viscosity of the recirculating coating composition and the resulting undesirable fluctuations in coating thickness are avoided with the process of this invention. Preferably, large variations in the viscosity per unit time of the coating solution at the inlet to the coating vessel is less than about 0 centipoise per minute to about 2 centipoise per minute. Thus, one may anticipate separation of the components of a coating solution and variations in thickness of coatings by measuring variation per unit time of the coating solution viscosity at the inlet of the coating vessel. A second viscometer is not required at the inlet. For example, measuring of viscosity may be accomplished experimentally to establish a predetermined solvent replenishment rate. Preferably, the rate of scaling is about 0 milliliters to about 30 milliliters per about each 30 second interval for a solution vessel and dip tank system containing about 75 liters to about a 100 liters of a recirculating charge transport layer coating solution batch.

The added fresh replenishment solvent is stirred into the charge transport coating solution with the aid of any suitable stirring device such as propeller mixer 36. Other typical stirring devices include, for example, paddles, turbines, high shear agitators and the like. Although an electronic link between the viscometer 16 and valve 32 is preferred, the valve 32 can be controlled manually instead of using a computer such as controller 30. Generally, controller 30 is preferred because of the reduced reaction time in making the setting changes to valve 32. Viscosity information is sent from viscometer 16 to controller 30 by suitable wiring and the controller compares through any suitable algorithms the relationships of current viscosity readings to the predetermined target viscosity values and sends an activation or inactivation signal to valve 32 to add fresh replenishment solvent or terminate addition of fresh replenishment solvent to form a second charge transport layer coating solution having a viscosity less than the second predetermined viscosity and substantially equal to or greater than the first predetermined viscosity. Thus, the viscosity of the recirculating charge transport coating composition is maintained between about the first predetermined viscosity and the second predetermined viscosity. Preferably, the first predetermined viscosity is selected so that it optimizes the overall coating solution quality and gives the largest and most robust operating window for coating the charge transport layer. With the process of this invention, highly undesirable abrupt changes in the coating solution viscosity are avoided. Undesirable rapid changes in the viscosity can lead to variations in coating thickness and increased non-uniformity. Solvent should be added slowly (e.g., incrementally) to minimize the adverse effects of large and sudden additions which may cause sudden and rapid changes in viscosity.

Any suitable computer or controller may be utilized to control valve 32. Typical computers include, for example, a Model D3 Distributed Control System available from Texas Instruments and a PLC controller. Any suitable software may be utilized. The language may be in BASIC, Boolean Logic, C-Level and the like. The computer is programmed to perform calculations in any suitable manner to control valve 32 when the signal from viscometer 16 indicates that the viscosity of the recirculating charge transport coating solution reaches the second predetermined viscosity. The expression "substantially equal to the first predetermined viscosity" as employed herein is defined as a viscosity value in a range from slightly below the first predetermined viscosity to slightly above the first predetermined viscosity, i.e. less than about ±1 centipoise of the first predetermined viscosity. Preferably, the viscosity of the recirculating charge transport coating solution is returned to a value that is just less than the first predetermined viscosity. However, acceptable results are achieved when the viscosity is returned to a value that is equal to or slightly greater than the first predetermined viscosity. Returning to a slightly higher viscosity value than the first predetermined viscosity requires more frequent replenishment of solvent to the recirculating undeposited first charge transport layer coating solution because the difference (window size) in viscosities between the second predetermined viscosity and a value slightly higher than the first predetermined viscosity is reduced compared to returning to a viscosity value slightly lower than the first predetermined viscosity. Thus, the viscosity of the recirculating charge transport coating solution is preferably returned to a value that is within about ±1 centipoise of the first predetermined viscosity. The valve, under computer control, regulates the amount of replenishment solvent that is supplied from the solvent vessel to the recirculating charge transport layer coating solution. The replenishment solvent volume rate depends upon coating rate, coating thickness and other predetermined factors. However, the volume rate of solvent addition should not be so large as to cause adverse batch to batch fluctuations in deposited coating thickness. As described above, the valve allows the solvent to enter the solution vessel. The controller regulates the duration of time that the valve remains open.

Any suitable metering device may be utilized for control valve 32. Preferably, the control valve is adapted for activation and inactivation remotely by an electrical signal, pneumatic pressure, and the like. Typical control valves include, for example, solenoid operated valves, valves operated by two way acting pneumatic cylinders, and the like. Commercially available control valves include, for example, Model CF3M, available from Swagelok. Typical computers include, for example, a Model D3 Distributed Control System available from Texas Instruments and a PLC controller.

Any suitable vessels 10, 20 and 34 may be utilized to contain the charge transport solution or the solvent. Generally, the vessels are closed or enclosed in a housing during use to prevent contamination and are composed of a material which is chemically inert with respect to the components of the solutions or solvents. For example, a shutter (not shown) may be utilized over the dip coating vessel to retard evaporation of the coating solution applied to the drum to prevent loss of solvent from the solution from the dip coating tank when a drum is not immersed. Typical vessels are constructed from stainless steel, glass lined steel, Teflon, lined steel and the like.

As described above, continuous monitoring of the viscosity of the recirculating first charge transport layer coating solution is accomplished with the viscometer 16 and controller 30. When the recirculating first charge transport layer coating solution reaches a second predetermined viscosity that is greater than the first predetermined viscosity, replenishment solvent from a solvent vessel is added to the recirculating undeposited first charge transport layer coating solution with continuous mixing to form a second charge transport layer coating solution having a viscosity less than the second predetermined viscosity and substantially equal to the first predetermined viscosity. The resulting second charge transport layer coating solution has a viscosity substantially equal to the first predetermined viscosity of the first charge transport layer coating solution. To ensure that a homogenous second charge transport layer coating solution is formed with the added fresh solvent, the second charge transport layer coating solution is flowed along a tortuous path in static mixer 18 to form the homogeneous second charge transport layer coating solution. The homogeneous second charge transport layer coating solution is flowed from the static mixer 18 into the dip coating vessel 20 while maintaining laminar flow in the homogeneous second charge transport layer coating solution flowing into the dip coating vessel. Laminar flow is achieved by minimizing abrupt pressure drops in the flowing charge transport layer coating solution, utilizing pipes having smooth interior surfaces, avoidance of sharp bends in the pipes, utilizing a static mixer with a low pressure drop, and the like. The expression "laminar flow" as employed herein is defined as a flowing solution with physical and process properties possessing a Reynolds number of less than about 2100. The static mixer may be located anywhere in the system between the exit of the solution vessel 10 and the entrance of the dip coating vessel 2. However, to ensure homogeneity and laminar flow, the mixer 18 is preferably positioned as close as possible to the inlet 38 of dip coating vessel 20. Thus, preferably, the static mixer 18 is located immediately adjacent the dip coating vessel 20. The flow rate of the coating solution into the coating vessel 20 should be substantially constant. Fluctuations in the flow rate can cause undesirable fluctuations of the meniscus between the cylindrical member 22 as it is being withdrawn from a coating bath 26. These undesirable fluctuations of the meniscus will cause undesirable thickness variations along the length of the cylindrical member.

Although a single dip coating vessel 20 is shown in FIG. 1, the flowing charge transport layer coating solution may be fed to a plurality of dip coating vessels (not shown). A single static mixer may be positioned immediately prior to a manifold (not shown) which channels the flowing charge transport layer coating solution to a plurality of dip coating vessels or a static mixer may be positioned between the manifold and the inlet of each dip coating vessel. If desired, a static mixer may be located before the entrance to the manifold in combination with additional static mixers between the manifold and each dip coating tank.

Undeposited second charge transport layer coating solution may be recirculated and repeatedly and sequentially applied to additional fresh cylindrical members in the dip coating vessel. As the viscosity of the recirculated second charge transport layer coating solution increases to the level of the second predetermined viscosity, the addition of fresh solvent is repeated and this process for maintaining the viscosity of the recirculating charge transport layer coating solution between the first predetermined viscosity and the second predetermined viscosity is repeated, as necessary, for future cycles to coat additional fresh cylindrical members.

As an illustration, if the recirculating charge transport layer coating solution initially has a first predetermined viscosity value of 300 centipoise and gradually builds up to a second predetermined viscosity value of 303 centipoise, such second predetermined viscosity value is detected by the viscometer 16 and the viscometer 16 sends a signal to controller 30 which, in turn, signals valve 32 to open to introduce fresh solvent into the solution vessel 10 to reduce the viscosity of the recirculating charge transport layer coating solution to the first predetermined viscosity value. The specific first and second predetermined viscosity values, rates of solvent addition, and the like depend upon the specific materials selected for use in the solution, the thickness desired for the deposited coating, and the like and are easily determined experimentally.

Generally, an electrophotoconductive member prepared with the process of this invention comprises two electrically operative layers on a coated or uncoated cylindrical member. The substrate may comprise numerous suitable materials having the required mechanical properties.

A conductive layer or ground plane which may comprise the entire cylindrical member or be present as a coating on an underlying member may comprise any suitable material including, for example, aluminum, titanium, nickel, chromium, brass, gold, stainless steel, carbon black, graphite and the like. The conductive layer may vary in thickness over substantially wide ranges depending on the desired use of the electrophotoconductive member. The underlying member may be of any conventional material including metal, plastics and the like. Typical underlying members include insulating non-conducting materials comprising various resins known for this purpose including polyesters, polycarbonates, polyamides, polyurethanes, and the like. The coated or uncoated cylindrical member may be rigid or flexible.

If desired, any suitable blocking (charge barrier) layer may be interposed between the conductive layer and the charge generating layer. The blocking layer may comprise any suitable material including, for example, polymers such as polyvinylbutyral, epoxy resins, polyesters, polysiloxanes, polyamides, polyurethanes, and the like. Materials for the charge barrier layer are disclosed, for example, in U.S. Pat. No. 5,244,762 and U.S. Pat. No. 4,988,597, the entire disclosures thereof being incorporated herein by reference. A preferred blocking layer comprises a reaction product between a hydrolyzed silane and a metal oxide layer of a conductive anode. Typical hydrolyzable silanes include 3-aminopropyl triethoxy silane, (N,N'-dimethyl-3-amino) propyl triethoxysilane, N,N-dimethylamino phenyl triethoxy silane, N-phenyl aminopropyl trimethoxy silane, trimethoxy silylpropyldiethylene triamine and mixtures thereof. These hydrolyzed silanes form a siloxane coating which is described, for example, in U.S. Pat. No. 4,464,450, the entire disclosure of this patent being incorporated herein by reference. Moreover, any other suitable blocking layer such as film forming polymers may be used instead of hydrolyzed silanes. Any suitable technique may be utilized to apply the blocking layer. Typical application techniques include spraying, dip coating, roll coating, wire wound rod coating, extrusion die coating and the like.

Any suitable charge generating or photogenerating material may be employed in one of the two electrically operative layers in the multilayer photoconductor prepared by the process of this invention. Typical charge generating materials include metal free phthalocyanine described in U.S. Pat. No. 3,357,989, metal phthalocyanines such as copper phthalocyanine, quinacridones, bisbenzoimidazoles, substituted 2,4-diamino-triazines disclosed in U.S. Pat. No. 3,442,781, and polynuclear aromatic quinones available from Allied Chemical Corporation under the tradename Indofast Double Scarlet, Indofast Violet Lake B, Indofast Brilliant Scarlet and Indofast Orange. Other examples of charge generator layers are disclosed in U.S. Pat. No. 4,265,990, U.S. Pat. No. 4,233,384, U.S. Pat. No. 4,306,008, U.S. Pat. No. 4,299,897, U.S. Pat. No. 4,232,102, U.S. Pat. No. 4,233,383, U.S. Pat. No. 4,415,639 and U.S. Pat. No. 4,439,507. The entire disclosures of these patents being incorporated herein by reference.

Any suitable inactive resin binder material may be employed in the charge generator layer. Typical organic resinous binders include polycarbonates, acrylate polymers, vinyl polymers, cellulose polymers, polyesters, polysiloxanes, polyamides, polyurethanes, epoxies, polystyrene, polyvinylbutyral, polyvinyl pyrrolidone, methyl cellulose, polyacrylates, cellulose esters, and the like. Many organic resinous binders are disclosed, for example, in U.S. Pat. No. 3,121,006 and U.S. Pat. No. 4,439,507, the entire disclosures of which are incorporated herein by reference. Organic resinous polymers may be block, random or alternating copolymers.

The photogenerating layer containing photoconductive compositions and/or pigments, and the resinous binder material generally ranges in thickness of from about 0.1 micrometer to about 5 micrometers, and preferably has a thickness of from about 0.3 micrometer to about 3 micrometers. Thicknesses from about 0.1 micrometer to about 10 micrometers outside these ranges can be selected providing the objectives of the present invention are achieved.

Generally, charge generating layer dispersions for dip coating mixtures contain pigment and film forming polymer in the weight ratio of from 20 percent pigment/80 percent polymer to 80 percent pigment/20 percent polymer. The pigment and polymer combination are dispersed in solvent to obtain a solids content of between about 3 and about 6 weight percent based on total weight of the mixture. However, percentages outside of these ranges may be employed so long as the objectives of the process of this invention are satisfied. The specific proportions selected depends to some extent on the thickness of the generator layer.

Other typical photoconductive layers include amorphous or alloys of selenium such as selenium-arsenic, selenium-tellurium-arsenic, selenium-tellurium, and the like.

Any suitable and conventional technique may be utilized to prepare the photogenerating layer coating mixture. The photogenerating layer coating mixture is preferably applied by dip coating. Drying of the deposited coating may be effected by any suitable conventional technique such as oven drying, infra red radiation drying, air drying and the like.

Typical charge transport layer coating compositions comprise suitable charge transport material in a solution of a film forming polymer. Typical charge transport materials include, for example, compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and the like, and hydrazone compounds. Typical film forming polymers include, for example, resins such as polycarbonate, polymethacrylates, polyarylate, polystyrene, polyester, polysulfone, styrene-acrylonitrile copolymer, styrene-methyl methacrylate copolymer, and the like. Preferably, the charge transport layer after drying comprises between about 25 to about 75 percent by weight of at least one charge transporting compound, about 75 to about 25 percent by weight of an polymeric film forming resin in which the charge transporting compound is soluble.

A preferred charge transporting compound is an aromatic amine compound. Examples of charge transporting aromatic amines for charge transport layers capable of supporting the injection of photogenerated holes of a charge generating layer and transporting the holes through the charge transport layer include, for example, triphenylmethane, bis(4-diethylamine-2-methylphenyl) phenylmethane; 4',4"-bis (diethylamino)-2',2"-dimethyltriphenyl-methane,N,N'-bis (alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3"-methylphenyl)-(1,1'-biphenyl)-4,4'-diamine, and the like dispersed in an electrically inactive resin binder.

Any suitable resin binder soluble in a suitable solvent may be employed in the process of this invention. Typical resin binders include, for example, polycarbonate resin, polyvinylcarbazole, polyester, polyarylate, polyacrylate, polyether, polysulfone, and the like. Typical weight average molecular weights can vary from about 20,000 to about 1,500,000.

Any suitable solvent may be employed for the components of the charge transport layer. Typical solvents include, for example, tetrahydrofuran, monochlorobenzene, and the like and mixtures thereof. Preferably, the solvents comprise blends of low boiling and high boiling point solvents. These blends are preferred because different solvents evaporate at different rates. Slow solvent evaporation from the coated substrate helps improve coating quality by enabling uniform drying rates and drying patterns on the coated substrate. The proportions of low boiling and high boiling point solvents in a blend depends upon the specific film forming polymer, charge transport material, solvents and dip coating process conditions used. Generally, the blend of solvents comprises two different solvents having a difference in boiling point of between about 0° C. and about 90° C. Solvents are selected based on their ability to dissolve the solids (e.g., pigments, polymers, charge transport molecules and the like), and their ability to provide uniform coating quality, (i.e. free of streaks, drying-related problems, and the like). For example, tetrahydrofuran (THF) and monochlorbenzene (MCB) are chosen because THF dissolves required solids, and MCB is used because it has a higher boiling point than THF and helps improve coating quality. Also, the low boiling point solvent preferably has a boiling point between about 40° C. and about 42° C. and the high boiling point solvent preferably has a boiling point between about 132° C. and about 135° C. The proportion of low boiling solvent to high boiling point solvent may be between about 1:99 to about 99:1 by weight. When a blend of low boiling and high boiling point solvents are employed as a replenishment solvent, the mixture is preferably mixed in measured amounts and stored in a single solvent vessel, e.g., see solvent vessel 34 in FIG. 1, for controlled addition to the recirculating undeposited first charge transport layer coating solution to form the second charge transport layer coating solution. When a mixture of solvents having different boiling points are employed, the two solvents evaporate from the recirculating coating mixture at different rates and can cause a shift in the relative proportions of the two different solvents in the recirculating coating mixture. To compensate for this shift, the replenishment solvent is a premixed blend supplied from the single solvent replenishment vessel. For example, if a typical coating solution has a solvent weight ratio of 75:25 (low boiling point to high boiling point), the solvent addition system can comprise a solvent ratio which is richer than the coating solution in low boiling solvent, such as weight ratio of 98:2 (low boiling to high boiling). Since more low boiling point solvent evaporates from the dip coating vessel than high boiling point solvent, more low boiling point solvent is used in the solvent replenishment vessel. In other words, the replenishment solvent blend contains proportionately more low boiling point solvent than the solvent blend in the recirculating coating solution. The solvents are blended before they are introduced into the solvent replenishment vessel. From the solvent replenishment vessel, the ratio of solvents which are transferred to the solution vessel are constant and are added at the same rate. The solvent or solvent mixture should not boil at the ambient temperature of the dip coating vessel. Replenishment from a single vessel is preferred because it minimizes the complexity of the system and allows the use of a simple premix of solvents. Preferably, the solvent blend comprises a major amount of low boiling point solvent and a minor amount of high boiling point solvent. In an example of a typical solvent blend, the blend contains about 98 percent by weight tetrahydrofuran and about 2 percent by weight monochlorobenzene. This minor amount of monochlorobenzene reduces the rate of evaporation of the coating composition solvent so that less solvent is consumed during the coating operation. The rate of solvent loss from the recirculating charge transport layer coating solution depends on the composition of the solvents in the coating solution. Factors such as coating cycle time, batch rate, air circulation, solution temperature, air temperature and the like, also affect the rate of solvent loss.

It is also desirable that temperature uniformity be maintained for the charge transport layer coating composition during the dip coating operation. The temperature of the replenishment solvent should be at about the temperature of the recirculating charge transport layer coating composition. Thus, temperature uniformity prevents separation of components and facilitates achievement of a more uniform coating. If there are variations in temperature, heat transfer can occur because the coating composition is at a different temperature than the ambient temperature. This adversely affects the homogeneity of the coating solution. The solvent is preferably at ambient temperature. The maximum temperature difference between the added solvent and the recirculating coating solution is preferably less than about 2° C.

An illustrative charge transport layer coating composition contains, for example, about 10 percent by weight N,N'-diphenyl-N,N'-bis(3-methylphenyl)-[1,1'-biphenyl]-4,4'diamine; about 14 percent by weight poly(4,4'-diphenyl-1,1'-cyclohexane carbonate (400 molecular weight); about 57 percent by weight tetrahydrofuran; and about 19 percent by weight monochlorobenzene. Depending on the specific charge transport layer coating composition selected and the dip coating conditions utilized including, for example, rate of withdrawal of a drum from a coating bath, a charge transport layer dip coating composition can have a viscosity between about 250 centipoise and about 500 centipoise at a solids concentration of about 20 percent, based on the total weight of the coating composition.

Drying of the deposited coating may be effected by any suitable conventional technique such as oven drying, infra red radiation drying, air drying and the like. Generally, the thickness of the dried transport layer is between about 5 to about 100 micrometers, but thicknesses outside this range can also be used.

The dried charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generator layer is preferably maintained from about 2:1 to 200:1 and in some instances as great as 400:1.

The charge generating layer should exhibiting the capability of photogeneration of holes and injection of the holes and the charge transport layer should be substantially non-absorbing in the spectral region at which the charge generating layer generates and injects photogenerated holes but being capable of supporting the injection of photogenerated holes from the charge generating layer and transporting the holes through the charge transport layer.

Thus, the coating system of present invention provides an improved photoreceptor dip coating fabrication system which rapidly adjusts viscosity of a charge transport layer dip coating composition while avoiding thermal, viscosity, and solution inhomogeneities to achieve uniform high quality final photoreceptors from one coating batch to another. Moreover, the fabrication system allows rapid adjustments while the fabrication process is in progress. Also, the amount of photoreceptor scrap during fabrication is markedly reduced. In addition, the photoreceptor fabrication system of this invention produces high quality dip coated photoreceptors.

PREFERRED EMBODIMENT OF THE INVENTION

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE 1

Hollow aluminum drums, each having a diameter of 30 millimeters, a length of 340 millimeters having a thickness of approximately 24 micrometers, a charge blocking layer having a thickness of approximately 1 micrometer and a charge generating layer having a dried thickness of approximately 0.25 micrometer may be dip coated with a coating system similar to that illustrated in FIG. 1 to form a charge transport layer thereon. The charge transport layer coating composition can initially contain approximately 5 percent by weight N,N'-diphenyl-N,N'-bis(3-methylphenyl)-1,1'-biphenyl-4-4'-diamine, approximately 10 percent by weight poly(4,4'-diphenyl-1,1'-cyclohexane carbonate), and approximately 75 percent by weight solvents, the solvents containing 75 percent by weight tetrahydrofuran and 25 percent by weight monochlorobenzene. This initial charge transport layer coating composition is referred to as a first charge transport layer coating solution and initially can have a first predetermined viscosity of 300 centipoise, plus or minus 2 centipoise. Dip coating of the above described aluminum drum in this charge transport layer coating solution using a drum withdrawal rate of 120 millimeters per minute can form charge transport layers free of streaks. During recirculation of the charge transport layer coating solution during sequential coating of many aluminum drums, solvent will be lost thereby increasing the viscosity of the recirculating charge transport layer coating solution. Since streaks are likely to be observed in the deposited charge transport layer if the viscosity of the applied charge transport layer coating solution were allowed to reach approximately 310 centipoise, a target viscosity (second predetermined viscosity) having a value lower (e.g. 8 centipoise) than the undesirable viscosity of 310 centipoise can be set in the controller (Model EFD Valvemate 7000 Valve Controller, available from EFD Dispense Valve Systems). In other words, the coating solution is prevented from reaching the undesirable viscosity of 310 centipoise by intentionally selecting a target viscosity (e.g., 302 centipoise) for the second predetermined viscosity that is less than the 310 centipoise where streaks can form. Thus, when the viscometer measures a viscosity of 302 centipoise, solvent is added to the coating solution vessel in order to return the viscosity of the recirculating charge transport layer coating solution to a value of 300 centipoise, i.e., a viscosity substantially equal to the first predetermined viscosity. When the signals from the viscometer to the controller indicate that the recirculating charge transport layer coating solution viscosity has attained the second predetermined viscosity value, the controller can send an "open" signal to the pneumatically controlled valve (Model CF3M, available from Swagelok) in the supply line from the fresh replenishment solvent vessel to the solution vessel containing the recirculating undeposited charge transport layer coating solution. The fresh replenishment solvent can contain 98 percent by weight tetrahydrofuran and 2 percent by weight monochlorobenzene to compensate for the higher evaporation rate of the tetrahydrofuran relative to the evaporation rate of the monochlorobenzene. Upon opening of the valve, fresh solvent can be gradually fed at 30 second open cycles to the solution vessel until the viscosity of the recirculating charge transport layer coating solution returns to the first predetermined viscosity of 300 centipoise. The rate of fresh replenishment solvent addition during each 30 second open cycle is sufficiently low to ensure that variations in the viscosity per unit time of the recirculating undeposited charge transport layer coating solution at the inlet to the coating vessel is less than about 2 centipoise per minute. If the viscosity falls below 300 centipoise, the controller is programmed to do nothing and the coating solution will be allowed to continue recirculating until evaporation increases viscosity to a predetermined level below 302 centipoise. Mixing of the freshly added replenishment solvent and the recirculating undeposited charge transport layer coating solution will be initiated in the solution vessel and completed to ensure homogeneity of the coating solution by passing the mixture through a static mixer (Model #1 KMR SAN-12, available from Koch-Glitsch) located immediately adjacent to the inlet of the dip coating vessel. When the signals from the viscometer to the controller indicate that the viscosity of the recirculating undeposited charge transport layer coating solution has reached the first predetermined viscosity, the controller should signal the valve to close.

Although the invention has been described with reference to specific preferred embodiments, it is not intended to be limited thereto, rather those having ordinary skill in the art will recognize that variations and modifications may be made therein which are within the spirit of the invention and within the scope of the claims.

What is claimed is:

1. A process for fabricating an electrophotographic imaging member comprising providing a cylindrical member, depositing on the cylindrical member a coating of a first charge transport layer coating solution by dip coating the cylindrical member in a bath of the first charge transport layer coating solution in a dip coating vessel, the first charge transport layer coating solution comprising a film forming polymer, a charge transport material, and at least one volatile solvent, the first charge transport layer coating solution having a first predetermined viscosity and the solvent having a viscosity less than the first predetermined viscosity, recirculating undeposited first charge transport layer coating solution from the dip coating vessel to a charge transport layer coating solution vessel and back to the dip coating vessel, repeatedly and sequentially depositing on fresh cylindrical members a coating of the recirculating undeposited first charge transport layer coating solution by dip coating the fresh cylindrical members in a bath of the recirculating undeposited first charge transport layer coating solution in the dip coating vessel, recirculating undeposited first charge transport layer coating solution from the dip coating vessel to the charge transport layer coating solution vessel until the first charge transport layer coating solution reaches a second predetermined viscosity that is greater than the first predetermined viscosity, adding a replenishment solvent from a solvent vessel to the recirculating undeposited first charge transport layer coating solution with continuous mixing to form a second charge transport layer coating solution having a viscosity less than the second predetermined viscosity and substantially equal to the first predetermined viscosity, flowing the second charge transport layer coating solution along a tortuous path in a static mixer to form a homogeneous second charge transport layer coating solution, flowing the homogeneous second charge transport layer coating solution from the static mixer into the dip coating vessel while maintaining laminar flow in the homogeneous second charge transport layer coating solution flowing into the dip coating vessel, and repeatedly and sequentially depositing the stirred second charge transport layer coating solution on additional fresh cylindrical members in the dip coating vessel.

2. A process according to claim 1 wherein the static mixer is immediately adjacent the dip coating vessel.

3. A process according to claim 1 wherein the cylindrical member comprises a drum substrate coated with at least a charge generation layer.

4. A process according to claim 1 including applying a charge generation layer after application of the first charge transport layer coating solution.

5. A process according to claim 1 including using a viscometer to detect when the viscosity of the first charge transport layer coating solution reaches the second predetermined viscosity.

6. A process according to claim 5 including sending a signal from the viscometer to a controller when the first charge transport layer coating solution reaches the second predetermined viscosity.

7. A process according to claim 6 including sending a signal from the controller to a valve to add the replenishment solvent from the solvent vessel to the recirculating undeposited first charge transport layer coating solution to form the second charge transport layer coating solution having a viscosity substantially equal to the first predetermined viscosity.

8. A process according to claim 7 wherein the viscometer measures viscosity of the recirculating undeposited first charge transport layer coating solution as it flows from the charge transport layer coating solution vessel to the mixer.

9. A process according to claim 8 including sending a signal from the controller to the valve to terminate addition of the replenishment solvent when the second charge transport layer coating solution has a viscosity substantially equal to the first predetermined viscosity.

10. A process according to claim 1 including filtering the recirculating undeposited first charge transport layer coating solution as it flows from the charge transport layer coating solution vessel to the mixer.

11. A process according to claim 1 including pumping the recirculating undeposited first charge transport layer coating solution to flow it from the charge transport layer coating solution vessel to the mixer.

12. A process according to claim 1 including incrementally adding the replenishment solvent from the solvent vessel to the recirculating undeposited first charge transport layer coating solution to form the second charge transport layer coating solution having a viscosity substantially equal to the first predetermined viscosity.

13. A process according to claim 12 wherein incrementally adding of the replenishment solvent is at a rate of between about 0 to 30 milliliters per each 30 second interval.

14. A process according to claim 1 wherein the film forming polymer is a polycarbonate.

15. A process according to claim 14 wherein the solvent comprises a blend of at least two different solvents.

16. A process according to claim 15 wherein the blend of at least two different solvents comprises a low boiling point solvent having a boiling point between about 40° C. and about 42° C. and a high boiling point solvent having a boiling point between about 132° C. and about 135° C.

17. A process according to claim 1 wherein the at least one volatile solvent comprises a blend of a low boiling point solvent and a high boiling point solvent and the replenishment solvent contains proportionately more low boiling point solvent than the solvent in the recirculating undeposited first charge transport layer coating solution.

18. A process according to claim 1 wherein the at least one volatile solvent comprises a blend of a low boiling point solvent and a high boiling point solvent and the proportion of low boiling solvent to high boiling point solvent is between about 1:99 and about 99:1 by weight.

19. A process according to claim 1 wherein the homogeneous second charge transport layer coating solution from the static mixer is flowed into multiple dip coating vessels.

20. A process according to claim 1 wherein the replenishment solvent has a viscosity of between about 0.5 centipoise and about 3 centipoise and the first predetermined viscosity of the first charge transport layer coating solution is between about 250 centipoise and about 500 centipoise.

21. A process according to claim 1 wherein variation in the viscosity of the coating solution circulated to the dip coating vessel is maintained between about 0 centipoise per minute and about 2 centipoise per minute.

22. A process according to claim 1 wherein the homogeneous second charge transport layer coating solution flowing into the dip coating vessel has a Reynolds number of less than about 2100.

* * * * *